US006076908A

United States Patent [19]

Maffeo

[11] Patent Number: 6,076,908

[45] Date of Patent: Jun. 20, 2000

[54] DRAWER FOR STORAGE CABINET

[75] Inventor: Anthony A. Maffeo, East Haven, Conn.

[73] Assignee: Platt and LaBonia Co., North Haven, Conn.

[21] Appl. No.: 09/154,922

[22] Filed: Sep. 17, 1998

[51] Int. Cl.[7] ..... A47B 88/00

[52] U.S. Cl. ..... 312/334.7; 248/222.51

[58] Field of Search ..... 312/334.1, 334.7, 312/334.8, 348.1, 348.2, 350, 334.4, 330.1; 248/222.51; 384/22, 20, 23

[56] References Cited

U.S. PATENT DOCUMENTS

| | | | |
|---|---|---|---|
| 3,866,993 | 2/1975 | Dean et al. | 312/216 |
| 4,440,461 | 4/1984 | Powell et al. | 384/23 X |
| 4,838,627 | 6/1989 | Macias | 312/334.7 X |
| 5,632,542 | 5/1997 | Krivec | 312/334.7 |
| 5,681,102 | 10/1997 | Forsgren | 312/334.1 |
| 5,823,650 | 10/1998 | Lin | 312/348.1 |

*Primary Examiner*—Janet M. Wilkens
*Attorney, Agent, or Firm*—Raymond A. Nuzzo

[57] ABSTRACT

A cabinet drawer comprising a drawer and a pair of drawer outer slides. The drawer has a front wall, back wall, opposite sidewalls, and a drawer bottom. Each sidewall has an interior side facing the drawer bottom and an exterior side. Each exterior side has a plurality of engagement regions thereon. Each drawer outer slide is removably attached to the exterior side of a corresponding sidewall. Each slide has a plurality of complementary engagement regions. Each complementary engagement region is configured for engagement with a corresponding engagement region on the exterior side of a corresponding sidewall.

15 Claims, 4 Drawing Sheets

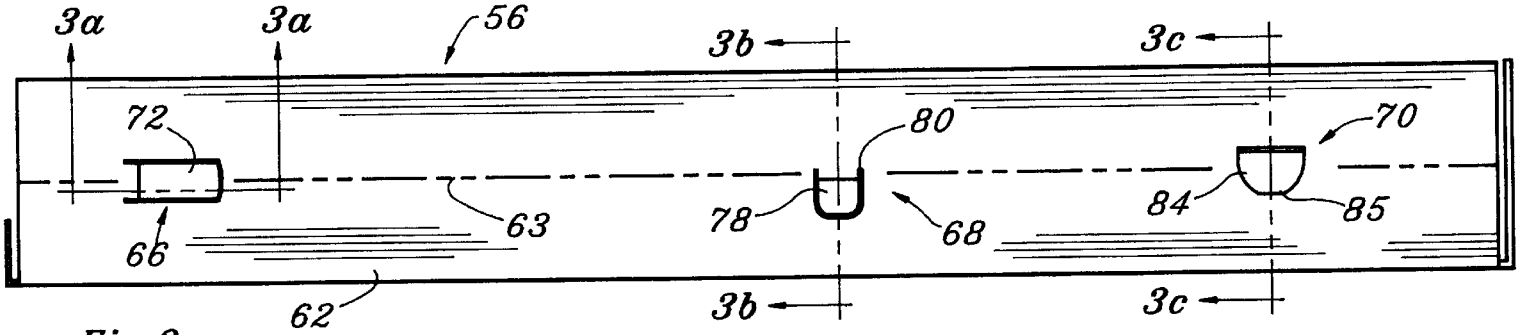
Fig.3
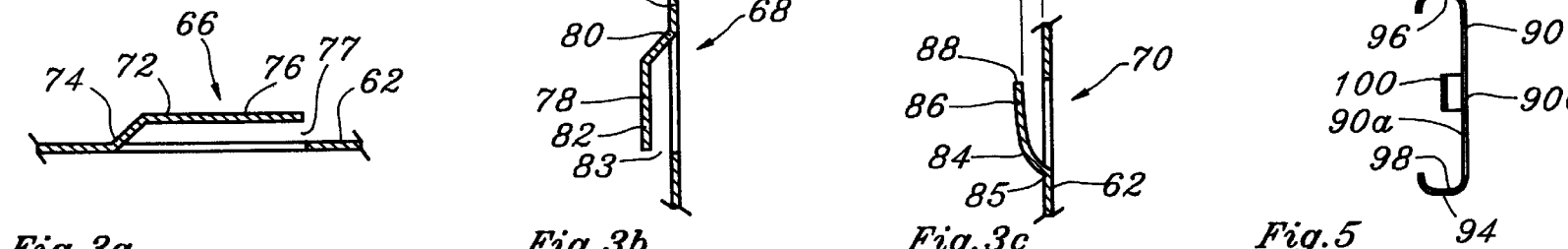
Fig.3a
Fig.3b
Fig.3c
Fig.5
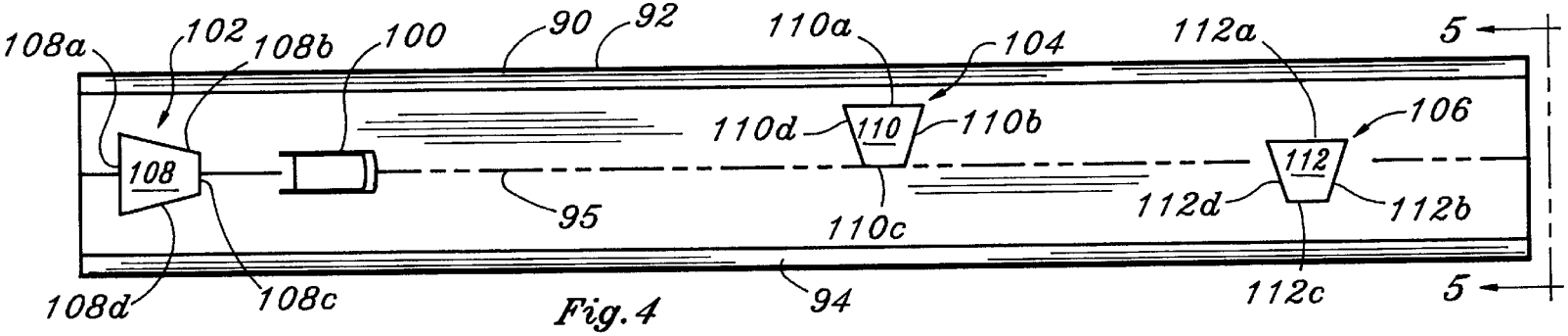
Fig.4

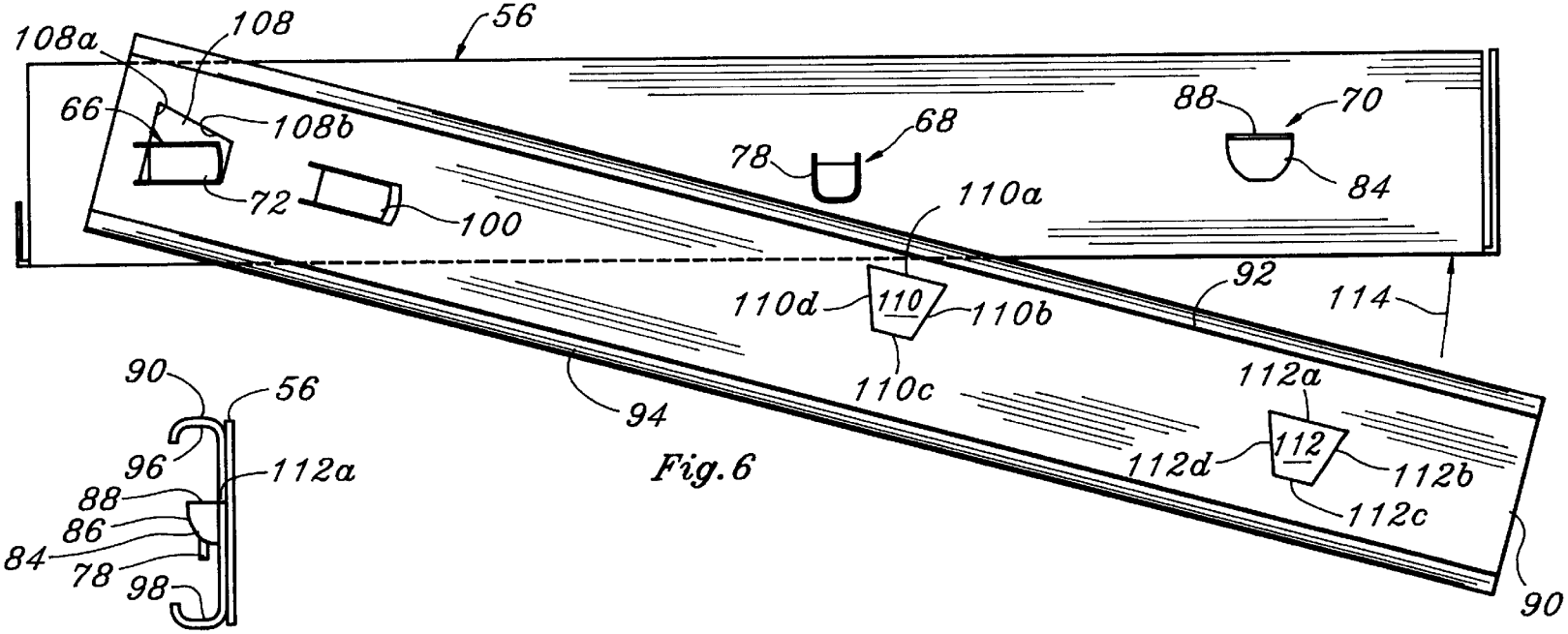
Fig. 6
Fig. 8
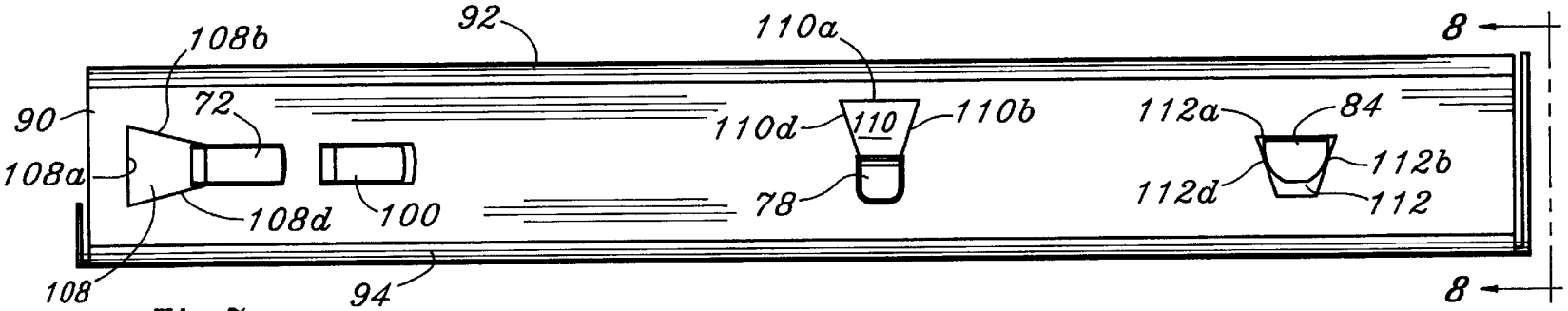
Fig. 7

DRAWER FOR STORAGE CABINET

BACKGROUND OF THE INVENTION

1. Field of the Invention

The present invention generally relates to a storage cabinets.

2. Problem to be Solved

Storage cabinets are used in industry for storing a variety of components such as tools, screws, nuts, washers, spare electrical components, etc. Such cabinets are also used in retail establishments, e.g. hardware and automotive parts stores, that sell components and supplies to consumers.

The aforementioned cabinets are typically fabricated from metal and generally comprise a metal box-like housing and a plurality of drawers that are slidably disposed within the housing. The cabinet includes a plurality of pairs of cabinet outer slides that are attached to the inner walls of the housing. One cabinet outer slide of each slide pair is attached to one inner wall and the other cabinet outer slide of the slide pair is attached to the opposite wall. The cabinet outer slides of each pair are aligned with one another. Each cabinet outer slide has a track for receiving an inner slide that is slidably engaged with the track of the cabinet outer slide. Each drawer of the housing has a pair of drawer outer slides that are rigidly attached to the exterior sides of the opposing sidewalls. The drawer outer slides are configured to engage the inner slides that are slidably attached to cabinet outer slides. Once the drawer outer slides are slidably engaged to the inner slides, the drawer can be slid into and out from the interior of the cabinet housing.

One disadvantage of the conventional drawer configuration described above is that the process of attaching the drawer outer slides to the exterior sides of the opposing sidewalls of the drawer is time consuming and as a result, increases the production costs of the drawer. Furthermore, if any of the drawer outer slides become damaged, the entire drawer must be replaced. The drawer is then either discarded or taken back to the factory for repair. Either one of these options is cost-inefficient, time consuming and disruptive.

It is therefore an object of the present invention to provide a new and improved cabinet drawer that solves the aforementioned problems.

It is another object of the present invention to provide a new and improved cabinet drawer that can be manufactured at reasonable costs.

Other objects and advantages of the present invention will be apparent to one of ordinary skill in the art in light of the ensuing description of the present invention.

SUMMARY OF THE INVENTION

The present invention is directed to, in one aspect, a cabinet drawer comprising a drawer and a pair of drawer outer slides. The drawer has a front wall, back wall, opposite sidewalls, and a drawer bottom. Each sidewall has an interior side facing the drawer bottom and an exterior side. Each exterior side has a plurality of engagement regions thereon. Each drawer outer slide is removably attached to the exterior side of a corresponding sidewall. Each slide has a plurality of complementary engagement regions. Each complementary engagement region is configured for engagement with a corresponding engagement region on the exterior side of a corresponding sidewall.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 3 is a side elevational view of the improved cabinet drawer of FIG. 2.

FIG. 3A is a view taken along line 3A—3A of FIG. 3.

FIG. 3B is a view taken along line 3B—3B of FIG. 3.

FIG. 3C is a view taken along line 3C—3C of FIG. 3.

FIG. 4 is a side elevational view of a drawer outer slide configured for attachment to the drawer of FIG. 3.

FIG. 5 is a view taken along line 5—5 of FIG. 4.

FIG. 6 is a side elevational view illustrating the manner in which the drawer outer slide of FIG. 4 is removably attached to the drawer of FIG. 2.

FIG. 7 is a side elevational view illustrating the drawer outer slide of FIG. 4 removably attached to the drawer of FIG. 2.

FIG. 8 is a view taken along line 8—8 of FIG. 7.

DETAILED DESCRIPTION OF THE INVENTION

In describing the preferred embodiments of the present invention, reference will be made herein to FIGS. 1–8 of the drawings in which like numerals refer to like features of the invention.

Figure 1:
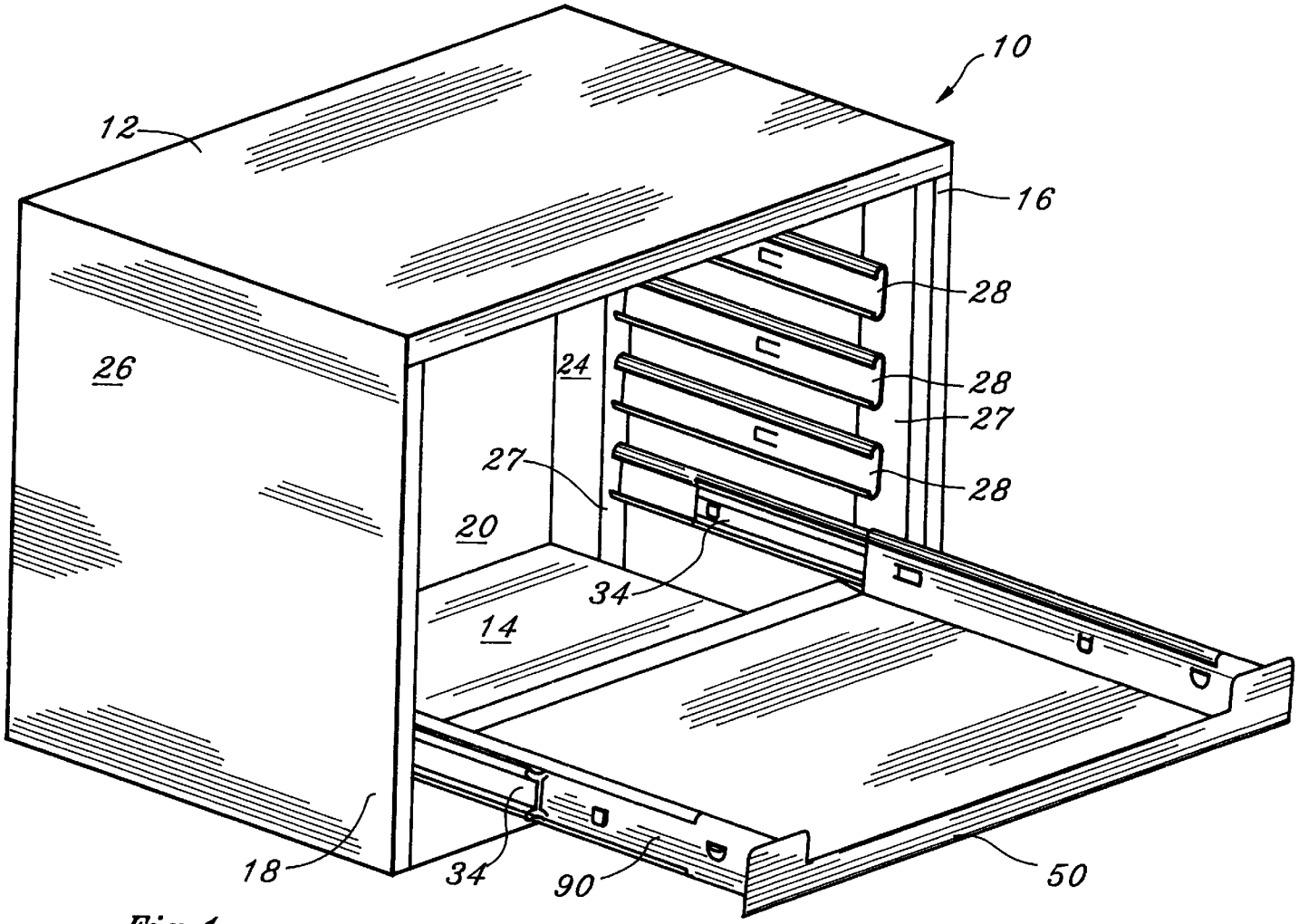
FIG. 1 is a perspective view of a cabinet utilizing the improved cabinet drawer of the present invention.

Referring to FIG. 1, there is shown cabinet 10. Cabinet 10 generally comprises top portion 12, bottom portion 14, sidewalls 16, 18 and rear wall 20. Cabinet 10 includes an interior region formed by top and bottom portions 12 and 14, respectively, and walls 16, 18 and 20. Sidewall 16 has an exterior side (not shown) and interior side 24 opposite the exterior side. Similarly, sidewall 18 has exterior side 26 and an interior side (not shown) opposite exterior side 26.

Referring again to FIG. 1, vertically oriented rails 27 are attached to interior side 24 of sidewalls 16. A plurality of cabinet outer slides 28 are rigidly and laterally attached to rails 27. The interior side (not shown) of sidewall 26 also has a pair of vertically oriented rails (such as rails 27) attached thereto and a plurality of cabinet outer slides (such as slides 28) rigidly attached to the rails.

FIG. 1 shows only interior side 24 of sidewall 16 and thus, the ensuing description is in terms of interior side 24, rails 27 and cabinet outer slides 28. However, it is to be understood that the ensuing description is also applicable to the interior side of sidewall 18. Referring to FIG. 1A, each cabinet outer slide 28 has longitudinally extending flanged ends 30 and 32 that form slide tracks 33*a* and 33*b*. Referring to FIG. 1B, inner slide 34 has a substantially planar and longitudinally extending body portion 36. Inner slide 34 includes upper longitudinally extending edge portion 38 that has a substantially U-shaped cross-section and comprises portions 38*a* and 38*b*. Inner slide 34 further includes lower longitudinally extending edge portion 40 that has a substantially U-shaped cross-section and comprises portions 40*a* and 40*b*.

Figure 1C:
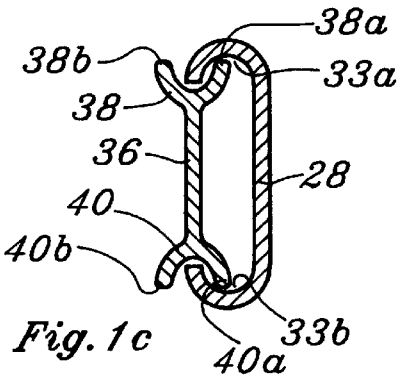
FIG. 1C is a cross-sectional view of the cabinet outer slide of FIG. 1A and the inner slide of FIG. 1B wherein the inner slide is slidably engaged with the cabinet outer slide.
Figure 1B:
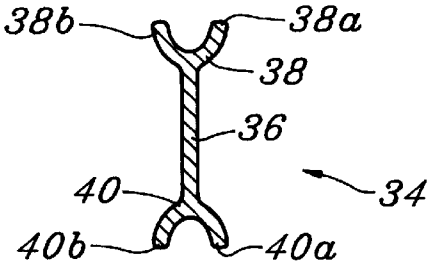
FIG. 1B is a cross-sectional view of an inner slide depicted in FIG. 1.
Figure 1A:
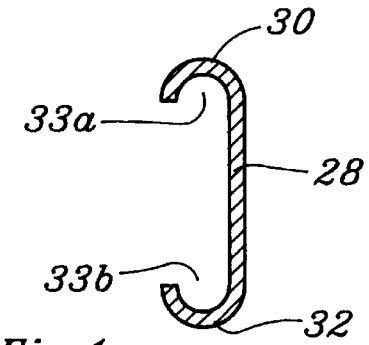
FIG. 1A is a cross-sectional view of a cabinet outer slide depicted in FIG. 1.

Referring to FIG. 1C, when inner slide 34 is slidably engaged with cabinet outer slide 28, portions 38*a* and 40*a* of inner slide 34 are slidably disposed within tracks 33*a* and 33*b*, respectively, thereby allowing inner slide 34 to slide horizontally into and out from the interior of cabinet 10. Inner slide 34 slides in a direction that is substantially parallel to the longitudinal axis of cabinet outer slide 28.

Figure 2:
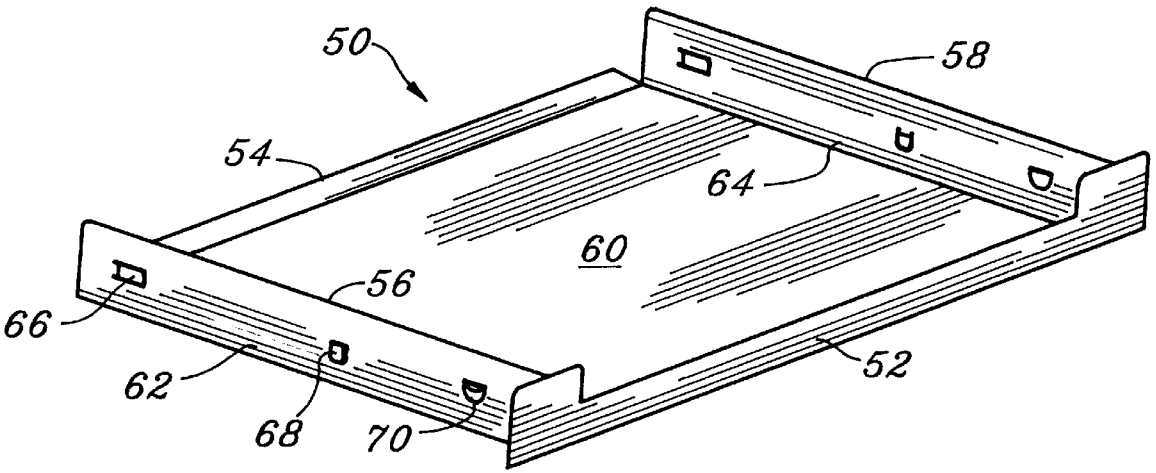
FIG. 2 is a perspective view of the improved cabinet drawer of the present invention.

Referring to FIG. 2, there is shown the improved cabinet drawer 50 of the present invention. Drawer 50 comprises front wall 52, back wall 54, opposite side walls 56 and 58, and drawer bottom 60. In one embodiment, drawer bottom 60 is substantially flat. In another embodiment, drawer 50 includes a plurality of dividers attached to drawer bottom 60 so as to form a plurality of compartments for storing components. Sidewall 56 has exterior side 62 and an interior side (not shown) that is opposite exterior side 62. Similarly, sidewall 58 has exterior side (not shown) and interior side 64 that is opposite the exterior side.

Referring to FIG. 3, exterior side 62 of sidewall 56 is shown. Although the ensuing description is in terms of exterior side 62, it is to be understood that the description is applicable to the exterior side (not shown) of sidewall 58. Exterior side 62 has a longitudinally extending axis 63. Exterior side 62 further includes engagement regions 66, 68 and 70 thereon. Referring to FIGS. 3 and 3A, in one embodiment, engagement region 66 comprises lip 72. Lip 72 has base portion 74 that is attached to side 62 and extending portion 76 which is spaced apart from the plane of side 62 by space or gap 77. Portion 76 extends in a direction that is substantially parallel to longitudinal axis 63. Referring to FIG. 3B, in one embodiment, engagement region 68 comprises lip 78. Lip portion 78 has base portion 80 that is attached to side 62 and extending portion 82 that is spaced apart from the plane of side 62 by space or gap 83. Portion 82 extends in a downward direction that is substantially perpendicular to longitudinal axis 63. Referring to FIG. 3C, in one embodiment, engagement region 70 comprises protrusion 84. Protrusion 84 extends from surface 62 and includes base portion 85 and rounded surface 86 and perimetrical edge 88. Protrusion 70 protrudes from surface 62 by a predetermined distance D. In a preferred embodiment, engagement regions 66, 68 and 70 are vertically positioned with respect to axis 63 as shown in FIG. 3. Axis 63 longitudinally bisects side wall 56. As shown in FIG. 3, axis 63 (i) bisects lip 72, (ii) overlaps the point of contiguity between base portion 80 of lip 78 and surface 62, and (iii) overlaps the point of contiguity between base portion 85 of protrusion 84 and surface 62.

Although the foregoing discussion is in terms of three (3) engagement regions, it is to be understood that more or fewer than three (3) engagement regions can be utilized. Furthermore, although engagement region 66, 68 an 70 have been shown to comprise lip 72, lip 78 and protrusion 84, respectively, it is to be understood that engagement regions 66, 68 and 70, can have other configurations. In a preferred embodiment, engagement regions 66, 68 and 70 are integrally formed on side 62 during fabrication of drawer 50. For example, if drawer 50 is fabricated from metal, engagement regions 66 and 68 are formed by a process referred to as "blanking". In such a process, lips 72 and 78 are formed from the material of sidewall 62 that is punched or stamped out. In a preferred embodiment, protrusion 84 is formed by the creation of what is known as a "half-round bump" or "half-round protrusion". In order create such a bump or protrusion, a round or circular protrusion or bump is made in the sheet of metal from which side 62 is fabricated. The protrusion or bump is then cut at is midpoint, i.e. across the diameter. One half of the protrusion or bump is hammered or flattened while the remaining half remains intact. The half that remains becomes the half-round bump. In an alternate embodiment, engagement regions 66, 68 and 70 are separate pieces that are attached to side 62.

Referring to FIGS. 4 and 5, there is shown drawer outer slide 90. Drawer outer slide 90 comprises surfaces 90*a*, 90*b* and longitudinally extending flanged ends 92 and 94. Slide 90 has a longitudinally extending axis 95. Flanged end 92 forms track 96. Similarly, flanged end 94 forms track 98. Tracks 96 and 98 receive longitudinally extending edges 38*b* and 40*b*, respectively, of inner slide 34 (see FIG. 1C). Drawer outer slide 90 further includes protrusion 100 that extends from surface 90*a* and extends in a direction that is generally parallel to longitudinal axis 95. Protrusion 100 engages with a complementary engagement region (not shown) on inner slide 34 to prevent drawer 50 from becoming totally disengaged from inner slide 34. Drawer outer slide 90 further comprises complementary engagement regions 102, 104 and 106 that correspond to engagement regions 66, 68 and 70, respectively. In a preferred embodiment, each complementary engagement region 102, 104 and 106 comprises an opening or cut-out. More preferably, each engagement region 102, 104 and 106 comprises an opening that is in the shape of a trapezoid. The purpose of such a configuration will be discussed below. Referring to FIG. 4, region 102 comprises a trapezoidal shaped opening 108 having perimetrical edges 108*a–d*. Opening 108 is oriented in a manner such that the width of the trapezoid decreases from left to right, i.e. from edge 108*a* to edge 108*c*. The purpose of such a configuration will be discussed below. Similarly, engagement region 104 comprises opening 110 that has a shape that is substantially trapezoidal in shape. Opening 110 has a perimetrical edges 110*a–d*. As shown in FIG. 4, the width of trapezoidal opening 110 decreases in a downwardly direction, i.e. from edge 110*a* to edge 110*c*. The purpose of such a configuration will be discussed below. Similarly, engagement region 106 comprises opening 112 that has a substantially trapezoidal shape and has perimetrical edges 112*a–d*. The width of opening 112 decreases in a downward direction, i.e. from edge 112*a* to edge 112*c*. The purpose of such a configuration will be discussed below.

Although openings 108, 110 and 112 have been described above as having a substantially trapezoidal shape, it is to be understood that such a shape is preferred but not necessary, and that openings having other shapes can also be used.

Referring to FIG. 4, openings 108, 110 and 112 are preferably positioned with respect to axis 95 as shown. Specifically, openings 108, 110 and 112 are positioned such that axis 95 (i) bisects opening 108, (ii) overlaps edge 110*c* of opening 110, and (iii) extends across opening 112.

Referring to FIG. 6, in order to removably attach drawer outer slide 90 to exterior side 62 of sidewall 56, drawer outer slide 90 is positioned such that lip 72 of engagement region 66 is disposed within opening 108 of engagement region 102. Referring to FIGS. 6 and 7, slide 90 is then pivoted upward as indicated by arrow 114 so that lip 78 of engagement region 68 is disposed within opening 110 of complementary engagement region 104 and edge 112*a* of opening 112 contacts perimetrical edge 88 of protrusion 84. As slide 90 is pivoted as indicated by arrow 114, side 90*b* of slide 90

(see FIG. 5) slides over rounded surface 86 of protrusion 84. The rounded contour of surface 86 facilitates sliding surface 90*b* of slide 90 over protrusion 84 in order to effect contact of edge 112*a* with edge 88. Referring to FIG. 8, when lips 72 and 78 are disposed within openings 102 and 104, respectively, and edge 112*a* contacts edge 88, slide 90 is substantially flush with side 62 of sidewall 56. The vertical orientation of engagement regions 66, 68 and 70 with respect to axis 63 (see FIG. 3) provides frictional firm, contact between edge 112*a* of opening 112 and perimetrical edge 88 of protrusion 84. The frictional engagement between edge 112*a* and edge 88 provides a tight-fitting relationship between edge 112*a* and edge 88 so as to prevent slide 90 from becoming dislodged from exterior side 62 of sidewall 56.

Referring to FIGS. 6 and 7, the portion of each opening 108, 110 and 112 having the widest width facilitates insertion therein of lips 72, 78 and protrusion 84, respectively. The smallest width of each opening 108 and 110 cooperates with protrusion 84 to prevent vertical and lateral movement of drawer outer slide 90 relative to exterior side 62 of sidewall 56 when drawer outer slide 90 is attached to side 62. Specifically, the width of perimetrical edge 108*c* of opening 108 is just slightly larger than the width of the base portion 74 of lip 72 so as to allow contact between edge 108*c* and base portion 74 and yet prevent vertical movement of drawer outer slide 90 relative to side 62. Similarly, the width of perimetrical edge 110*c* of opening 110 is just slightly larger than the width of base portion 80 of lip 78 so as to allow contact between edge 110*c* and base portion 80 and yet prevent lateral or horizontal movement of drawer outer slide 90 relative to side 62. The vertical alignment of lips 72, 78 and protrusion 84 relative to axis 63 and the vertical alignment of openings 108, 110 and 112 relative to axis 95 provide for a firm or snug attachment of drawer outer slide 90 to exterior side 62. However, such a configuration does not prevent a user from removing drawer outer slide 90 as will be shown below.

Referring to FIG. 8, in order to remove or disengage slide 90 from sidewall 56 of drawer 50, slide 90 is pulled or moved, relative to sidewall 56, in the direction indicated by arrow 116 until edge 112*a* no longer contacts edge 88. Slide 90 is then pivoted downward (opposite to that shown in FIG. 6). Once side 90*b* no longer contacts rounded portion 86 of protrusion 84, slide 90 can be freely pivoted downward so as to enable withdrawal of lips 72 and 78 from openings 108 and 110, respectively.

Thus, the improved cabinet drawer 50 of the present invention allows for the easy removal and replacement of the drawer outer slide 90. Furthermore, improved cabinet drawer 50 of the present invention (i) allows streamlining of production lines, (ii) decreases the per-unit fabrication time, and (iii) improves production yield.

In a preferred embodiment, drawer 50 of the present invention is fabricated from metals such as iron, steel, stainless steel, aluminum. In a most preferred embodiment, the metal is corrosion-resistant. However, drawer 50 can also be fabricated from other suitable materials such as rigid plastic.

Thus, drawer 50 of the present invention:

a) allows for easy replacement of damaged drawer outer slides;

b) eliminates the need for factory refitting of drawers or discarding drawers with damaged drawer outer slides;

c) can be configured to fit cabinets or varying sizes; and d) can be manufactured at a reasonable costs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cabinet drawer comprising:

a drawer having a front wall, back wall, opposite sidewalls, and a drawer bottom, each sidewall having (i) a longitudinally extending axis, (ii) an interior side facing the drawer bottom and (iii) an exterior side, each interior side having a substantially planar surface, each exterior side having a plurality of male engagement regions thereon which extend from the exterior side, a first one of the male engagement regions comprising a lip that is attached to the exterior side of the sidewall at a first predetermined position with respect to the longitudinally extending axis and which extends in a lateral direction that is generally parallel to the axis, a second one of the male engagement regions comprising a lip that is attached to the exterior side at a second predetermined position with respect to the longitudinally extending axis and which extends in a direction that is generally perpendicular to the sidewall axis, a third one of the male engagement regions of the sidewall comprising a half-round bump that is positioned at a third predetermined position with respect to the longitudinally extending axis, the half round bump having a perimetrical edge; and a pair of drawer outer slides, each drawer outer slide being removably attached to the exterior side of a corresponding drawer sidewall, each drawer outer slide having a plurality of female engagement regions, each of the female engagement regions corresponding to one of the male engagement regions, each of the female engagement regions comprising an opening having a perimetrical edge, the lip of the first one of the male engagement regions extending through a first one of the openings and over a portion of the outer slide, the lip of the second one of the male engagement regions extending through a second one of the openings and over a portion of the outer slide, the half round bump extending through a third one of the openings such that the perimetrical edge of the half round bump frictionally contacts the perimetrical edge of the third one of the openings so as to provide a tight-fit between the drawer outer slide and the drawer sidewall;

the orientation and positioning of the male engagement regions with respect to the longitudinally extending axis of each drawer sidewall preventing substantially upward, downward and lateral movement of the drawer outer slides with respect to the drawer thereby effecting firm but removable attachment of the drawer outer slides to the exterior sides.

2. The cabinet drawer according to claim 1 wherein the plurality of male engagement regions extending from each exterior side of each sidewall comprises three male engagement regions.

3. The cabinet drawer according to claim 1 wherein the plurality of female engagement regions on each drawer outer slide comprises three female engagement regions.

4. The cabinet drawer according to claim 1 wherein each exterior side is configured so that the lip of the second one of the male engagement regions is intermediate the lip of the first one of the male engagement regions and the half round bump.

5. The cabinet drawer according to claim 1 wherein each of the openings of the female engagement regions has a substantially trapezoidal shape.

6. The cabinet drawer according to claim 1 wherein each sidewall is configured such that the longitudinally extending axis bisects the sidewall and wherein the lip of the second one of the male engagement regions and the half round bump each have a base portion attached to the exterior side of the sidewall, the lips and half round bump being positioned relative to the longitudinally extending axis such that the axis (i) bisects the lip of the first one of the engagement regions, (ii) overlaps an area of the exterior side to which the base portion of the lip of the second one of the engagement regions is attached, and (iii) overlaps an area of the exterior side to which the base portion of the half round bump is attached.

7. The cabinet drawer according to claim 1 wherein each drawer outer slide has a longitudinally extending axis that bisects the drawer outer slide, the openings of the female engagement regions of each drawer outer slide being positioned relative to the longitudinally extending axis of the drawer outer slide such that this axis (i) bisects the opening of the first one of the female engagement regions, (ii) overlaps a portion of the perimetrical edge of the opening of the second one of the female engagement regions, and (iii) extends across the opening of the third one of the female engagement regions such that a portion the opening of the third female engagement region is on either side of the axis of the drawer outer slide.

8. The cabinet drawer according to claim 1 wherein the drawer and the drawer outer slides are fabricated from metal.

9. The cabinet drawer according to claim 1 wherein each drawer outer slide has an engagement region for engaging a complementary engagement region on an inner slide.

10. A cabinet drawer comprising a front wall, back wall, opposite sidewalls, and a drawer bottom, each sidewall having (i) a longitudinally extending axis, (ii) an interior side facing the drawer bottom and (iii) an exterior side, each interior side having a substantially planar surface, each exterior side having a plurality of male engagement regions extending outwardly from the exterior side for engagement with female engagement regions on a drawer outer slide such that the drawer outer slide can be removably attached to the sidewall, a first one of the male engagement regions of the sidewall comprising a lip that is attached to the exterior side at a first predetermined position relative to the longitudinally extending axis and which extends in a lateral direction that is generally parallel to the axis of the sidewall, a second one of the male engagement regions of the sidewall comprising a lip that is attached to the exterior side at a second predetermined position relative to the longitudinally extending axis and which extends in a direction that is generally perpendicular to the longitudinally extending axis of the sidewall, a third one of the male engagement regions of the sidewall comprising a half round bump that is positioned at a third predetermined position with respect to the longitudinally extending axis, the half round bump having a perimetrical edge.

11. The cabinet drawer according claim 10 wherein each sidewall is configured such that the longitudinally extending axis bisects the sidewall and wherein the lip of the second one of the male engagement regions and the half round bump each have a base portion attached to the exterior side of the sidewall, the lips and half round bump being positioned relative to the longitudinally extending axis such that the axis (i) bisects the lip of the first one of the male engagement regions, (ii) extends through an area of the exterior side to which the base portion of the lip of the second one of the male engagement regions is attached, and (iii) extends through an area of the exterior side to which the base portion of the half round bump is attached.

12. The cabinet drawer according to claim 11 wherein the cabinet drawer is fabricated from metal.

13. A drawer outer slide for removable attachment to an exterior side of a drawer sidewall, the drawer outer slide having a longitudinally extending axis that bisects the drawer outer slide, the drawer outer slide further including three trapezoidal shaped openings for engagement with corresponding male engagement regions on the exterior side of the drawer sidewall such that the drawer outer slide can be removably attached to the exterior side, each trapezoidal shaped opening having a perimetrical edge, each trapezoidal shaped opening being positioned relative to the longitudinally extending axis such that the axis (i) bisects a first one of the trapezoidal shaped openings, (ii) overlaps a portion of the perimetrical edge of a second one of the trapezoidal shaped openings, and (iii) extends across a third one of the trapezoidal shaped openings such that a portion of the third trapezoidal shaped opening is on either side of the axis of the drawer outer slide, the second one of the trapezoidal shaped openings being intermediate the first and third trapezoidal shaped openings, the first one of the trapezoidal shaped openings having a width that tapers in the direction of the second opening, the second trapezoidal shaped opening having a width that tapers in a direction that is generally perpendicular to the longitudinally extending axis, the third trapezoidal shaped opening having a width that tapers in a direction that is generally perpendicular to the longitudinally extending axis, the drawer outer slide further comprising a protrusion for engagement with a complementary engagement region of an inner slide, the protrusion being intermediate the first and third openings, the protrusion having a first portion that is attached to the drawer outer slide and a second portion that is attached to the first portion and which longitudinally extends toward the second trapezoidal shaped opening and in a direction that is generally parallel to the longitudinally extending axis.

14. A cabinet drawer comprising:

a drawer having a front wall, back wall, opposite sidewalls, and a drawer bottom, each sidewall having (i) a longitudinally extending axis, (ii) an interior side facing the drawer bottom and (iii) an exterior side, each exterior side having a plurality of male engagement regions thereon which extend from the exterior side, a first one of the male engagement regions comprising a lip that is attached to the exterior side of the sidewall at a first predetermined position with respect to the longitudinally extending axis and which extends in a lateral direction that is generally parallel to the axis, a second one of the male engagement regions comprising a lip that is attached to the exterior side at a second predetermined position with respect to the longitudinally extending axis and which extends in a direction that is generally perpendicular to the sidewall axis, a third one of the male engagement regions of the sidewall comprising a half-round bump that is positioned at a third predetermined position with respect to the longitudinally extending axis, the half round bump having a perimetrical edge; and a pair of drawer outer slides, each drawer outer slide being removably attached to the exterior side of a corresponding drawer sidewall, each drawer outer slide having a plurality of female engagement regions, each of the female engagement regions corresponding to one of the male engagement regions, each of the female engagement regions comprising an opening having a perimetrical edge, the lip of the first one of the male engagement regions extending through a first one of the openings and over a portion of the outer slide, the lip of the second one of the male engagement regions extending through a second one of the openings and over a portion of the outer slide, the half round bump extending through a third one of the openings such that the perimetrical edge of the half round bump frictionally contacts the perimetrical edge of the third one of the openings so as to provide a tight-fit between the drawer outer slide and the drawer sidewall;

the orientation and positioning of the male engagement regions with respect to the longitudinally extending axis of each drawer sidewall preventing substantially upward, downward and lateral movement of the drawer outer slides with respect to the drawer thereby effecting firm but removable attachment of the drawer outer slides to the exterior sides.

15. A cabinet drawer comprising:

a drawer having a front wall, back wall, opposite sidewalls, and a drawer bottom, each sidewall having (i) a longitudinally extending axis, (ii) an interior side facing the drawer bottom and (iii) an exterior side, each exterior side having a plurality of male engagement regions thereon which extend from the exterior side, a first one of the male engagement regions comprising a lip that is attached to the exterior side of the sidewall at a first predetermined position with respect to the longitudinally extending axis and which extends in a lateral direction that is generally parallel to the axis, a second one of the male engagement regions comprising a lip that is attached to the exterior side at a second predetermined position with respect to the longitudinally extending axis and which extends in a direction that is generally perpendicular to the sidewall axis, a third one of the male engagement regions of the sidewall comprising a half-round bump that is positioned at a third predetermined position with respect to the longitudinally extending axis, the half round bump having a perimetrical edge; and a pair of drawer outer slides, each drawer outer slide being removably attached to the exterior side of a corresponding drawer sidewall, each drawer outer slide having a plurality of female engagement regions, each of the female engagement regions corresponding to one of the male engagement regions, each of the female engagement regions comprising an opening having a perimetrical edge, the lip of the first one of the male engagement regions extending through a first one of the openings and over a portion of the outer slide, the lip of the second one of the male engagement regions extending through a second one of the openings and over a portion of the outer slide, the half round bump extending through a third one of the openings such that the perimetrical edge of the half round bump frictionally contacts the perimetrical edge of the third one of the openings so as to provide a tight-fit between the drawer outer slide and the drawer sidewall;

the orientation and positioning of the male engagement regions with respect to the longitudinally extending axis of each drawer sidewall preventing substantially upward, downward and lateral movement of the drawer outer slides with respect to the drawer thereby effecting firm but removable attachment of the drawer outer slides to the exterior sides without the use of pins or screws and without dependence upon the weight of the drawer.

* * * * *